US007071697B2

(12) United States Patent
Rioufol et al.

(10) Patent No.: US 7,071,697 B2
(45) Date of Patent: Jul. 4, 2006

(54) CENTRALIZER INCLUDING MEASUREMENT MEANS

(75) Inventors: Emmanuel Rioufol, Rosharon, TX (US); Philippe Gambier, Rosharon, TX (US); Eric Veignat, Abbeville (FR); Ian Raw, Stavanger (NO); Ian David Bryant, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 244 days.

(21) Appl. No.: 10/250,517

(22) PCT Filed: Dec. 7, 2001

(86) PCT No.: PCT/EP01/14499

§ 371 (c)(1),
(2), (4) Date: Oct. 31, 2003

(87) PCT Pub. No.: WO02/053871

PCT Pub. Date: Jul. 11, 2002

(65) Prior Publication Data

US 2004/0178797 A1 Sep. 16, 2004

Related U.S. Application Data

(60) Provisional application No. 60/259,789, filed on Jan. 4, 2001.

(51) Int. Cl.
*G01V 3/18* (2006.01)

(52) U.S. Cl. ..... 324/366; 324/368; 324/339; 166/241.1; 166/241.7

(58) Field of Classification Search ..... 166/264, 166/250.1, 381, 241.1, 241.6, 241.7; 324/303, 324/338–339, 366–375
See application file for complete search history.

(56) References Cited

U.S. PATENT DOCUMENTS

| | | | | |
|---|---|---|---|---|
| 3,343,608 | A * | 9/1967 | Solum | 166/241.7 |
| 4,775,009 | A * | 10/1988 | Wittrisch et al. | 166/250.11 |
| 4,879,463 | A * | 11/1989 | Wraight et al. | 250/269.2 |
| 5,092,423 | A * | 3/1992 | Petermann | 181/102 |
| 5,200,705 | A * | 4/1993 | Clark et al. | 324/338 |
| 5,250,806 | A * | 10/1993 | Rhein-Knudsen et al. | 250/254 |
| 5,463,320 | A * | 10/1995 | Bonner et al. | 324/366 |
| 5,512,889 | A * | 4/1996 | Fletcher | 340/854.6 |
| 5,801,642 | A | 9/1998 | Meynier | |
| 5,883,516 | A * | 3/1999 | Van Steenwyk et al. | 324/366 |
| 5,926,024 | A * | 7/1999 | Blount et al. | 324/324 |
| 5,979,588 | A | 11/1999 | Havig | |
| 6,131,658 | A * | 10/2000 | Minear | 166/250.01 |

(Continued)

FOREIGN PATENT DOCUMENTS

| | | |
|---|---|---|
| EP | 0 505 261 | 3/1992 |
| EP | 0 656 547 | 10/1994 |

(Continued)

*Primary Examiner*—Jay M. Patidar
(74) *Attorney, Agent, or Firm*—Victor H. Segura; Brigitte L. Echols

(57) ABSTRACT

A centralizer (1) for position a casing (3) in a conduit (4) passing through underground formations includes measurement means (7) such as an electrode for deriving at least one representative parameter of the formations.

6 Claims, 4 Drawing Sheets

U.S. PATENT DOCUMENTS

| | | | | |
|---|---|---|---|---|
| 6,230,557 | B1 * | 5/2001 | Ciglenec et al. | 73/152.01 |
| 6,396,276 | B1 * | 5/2002 | Van Steenwyk et al. | 324/366 |
| 6,435,275 | B1 * | 8/2002 | Kirk et al. | 166/241.1 |
| 6,637,511 | B1 * | 10/2003 | Linaker | 166/241.7 |
| 6,725,939 | B1 * | 4/2004 | Richard | 166/384 |

FOREIGN PATENT DOCUMENTS

| | | |
|---|---|---|
| WO | WO 97 37103 | 10/1997 |
| WO | WO 00 66874 | 11/2000 |
| WO | WO 00 75485 | 12/2000 |

* cited by examiner

CENTRALIZER INCLUDING MEASUREMENT MEANS

This application is a 371 of PCT/EP01/14499 filed Dec. 7, 2001 which claims benefit of Provisional application Ser. No. 60/259,789 filed Jan. 4, 2001.

The present invention relates to a centralizing device ("centralizer") comprising measurement means. A preferred example of the application of a centralizer according to the invention relates to a centralizer intended to position a casing in a well passing through underground formations including a fluid reservoir, the aforementioned centralizer making it possible to make permanent measurements of at least a parameter representative of the aforementioned formation or of the aforesaid fluid.

After the drilling of an oil well or the like, a casing is lowered into the well and is cemented for all or part its height. When one lowers this casing into the well, it is necessary to fix centralizers on its walls to minimize both the friction against the formation and also the risks of deformation (torsion or inflection). Moreover, the centralizers ensure the adequate positioning of casing so that the annulus between the walls of the casing and those of the well is virtually identical in thickness over the entire length of casing, which allows in particular a homogeneous distribution of cement at the time of the cementing operation. The centralizes are also used when one lowers a production tube inside a casing. In this case, they are used concentrically to position the tubing in the casing, so as to decrease the friction during the descent and to guarantee a good positioning of the sealing packers between the interior of the tubing and the production zone.

After positioning of the casing and tubing, during the production of fluids such as hydrocarbons and/or gas coming from an underground layer, it is important to know the evolution and the behavior of the reservoir, the advance of the water front and the characteristics and the flow of the aforesaid fluids throughout the life of this layer. This makes it possible on the one hand to optimize the production and on the other hand to envisage the modifications suitable for affecting the reservoir. It is thus necessary to have continuous data relating to the behavior of the formations and/or the fluid. With this intention, sensors are usually installed permanently along the well.

In a general way, these devices for permanent measurements are positioned on casing intended to line the walls of the well or on the tubing intended to be positioned in the aforementioned casing. Patent FR-98 16090 illustrates one example of these devices. In this document, there is described a system adapted to install a measurement probe (intended in particular for seismic measurements) against the wall of a conduit, with a site of this one where it is brought by displacement of a sufficiently rigid, elongate support element. This system comprises a device for coupling each probe which includes a deformable element formed from a memory-shape alloy, to which the probe is fixed, this deformable element being adapted to change, under the action of a variation in temperature, from a retracted position away from the wall of the conduit to an extended position where the aforementioned probe is held against the wall. In this document, the deformable element, which must be associated with heating means, is not adapted to be cemented in the well. Moreover, the installation of the coupling device on the correct level of the conduit requires the use of complementary centralizers intended to position the element support, these centralizers not being used to position the tubing or casing themselves in the well. The U.S. patent application filed on Mar. 27 2000 in the name of Brian Clark et al for Schlumberger Technology Corporation describes a device making it possible to drill a well and to simultaneously take measurements of resistivity of the formations surrounding this well. This system has centralizers making it possible to position the tool holder in casing, the centralizer having also an electric function of short-circuit between the tool holder and casing to however decrease the effects of parasitic magnetic waves, these centralizers being adapted neither to be cemented in the well, nor to carry additional measurement means.

The presence, on the walls of casing or the tubing, of the centralizer and the devices of measurement at the same time poses many disadvantages. Indeed, it is difficult considering their obstruction to assemble a significant number of parts on these tubes. In particular, in the case of an assembly on casing, the presence of many parts increases discontinuities in the cemented annulus and thus the risks of bad cementing of the annulus. Moreover, these repetitive assemblies increase the risks of degradation of the whole system (and thus of failure) at the time of lowering into the well, which can represent a very high additional cost if should be necessary to raise the unit, to repair it and to lower it again into the well. Lastly, in particular when the measurement devices are electrodes to carry out measurements of resistivity from the casing through the formation, the proximity of the centralizer (generally metal) induces considerable disturbances in measurements. It can even create a short-circuit between the electrodes and the centralizer, which distorts measurements completely. Lastly, at the time that they are lowered into the well or casing, the measurement devices are relatively exposed (in particular when they are assembled on casing), and can easily deteriorate.

The present invention provides a centralizer for position a casing in a conduit passing through underground formations, the centralizer comprising measurement means for deriving at least one representative parameter of the formations.

The centralizer according to the invention thus makes it possible simply to decrease the number of parts present between the walls of the well and casing, which has a first advantage of decreasing the number of elements laid out on casing and of obtaining a better cementing of the annulus when it is cemented. Moreover this device makes it possible to greatly decrease the set-up times of the parts on casing or the tubing, which constitutes a significant financial profit at the time of the startup of the well.

The centralizer according to the invention comprises at least two substantially semi-cylindrical parts intended to be fixed one on the other so as to surround the casing. In a preferred example of realization, each substantially semi-cylindrical part comprises two half-rings separated by blades extending parallel to the axis from the conduit, the aforementioned blades making it possible to maintain a certain annular distance between the aforementioned casing and the aforementioned conduit. In one embodiment, at least one of the blades is rigid and the internal wall of the aforementioned blade comprises a recess intended to receive the measurement means.

In this manner, the recess in the internal wall of at least a blade of the device according to the invention makes it possible to protect the means from measurement at the time of their descent into the well or the tubing. This makes it possible to substantially increase the lifespan of the measurement means installed permanently in the wells.

In another advantageous example of the invention, at least one of the blades is flexible and has an substantially convex form so that the aforementioned blade is in contact with the walls of the conduit. In this example, the centralizer comprises moreover means of feeding electrical current, the aforementioned means injecting a current in the flexible blade so that the measured representative parameter is the resistivity of the formations surrounding the conduit.

Thus, the centralizer in conformity with the invention makes it possible to carry out in a very effective and reliable way measurements of resistivity in the formation surrounding the well or the annulus between the tubing and casing. Indeed, the flexible blades make it possible to ensure an optimal contact with the formation or the walls of casing. There are thus less risks of loss of current due to bad contacts. These measurements are also more reliable because the fact of amalgamating the functions of centralizer and electrode makes it possible to eliminate the risks from short-circuit as in the devices depending on the state of the art.

The invention also has as an aim an measurement electrode for a parameter representative of an underground formation, the aforementioned electrode being assembled on the walls of a casing extending in a conduit passing through the aforementioned formation, characterized in that the aforementioned electrode comprises of the means to position the aforementioned casing in the aforementioned conduit.

The invention also proposes a method of measurement of at least one parameter representative of an underground formation or a fluid contained in a reservoir of the aforementioned formation. According to the invention, this method comprises:

lowering a casing provided with at least one centralizer intended to position the aforementioned casing in a well passing through the formation and the reservoir, the aforementioned centralizer comprising measurement means for the representative parameter.

connecting the measurement means of the centralizer to means of feeding electrical current and to means of recording of the data;

circulating an electrical current in the formation; and measuring an electric parameter with the means of the aforesaid centralizer to deduce the parameter representative of the formation or the reservoir from it.

Other advantages and characteristics of the invention will be highlighted in the following description, given as an example, in reference to the annexed drawings in which.

Figure 1:
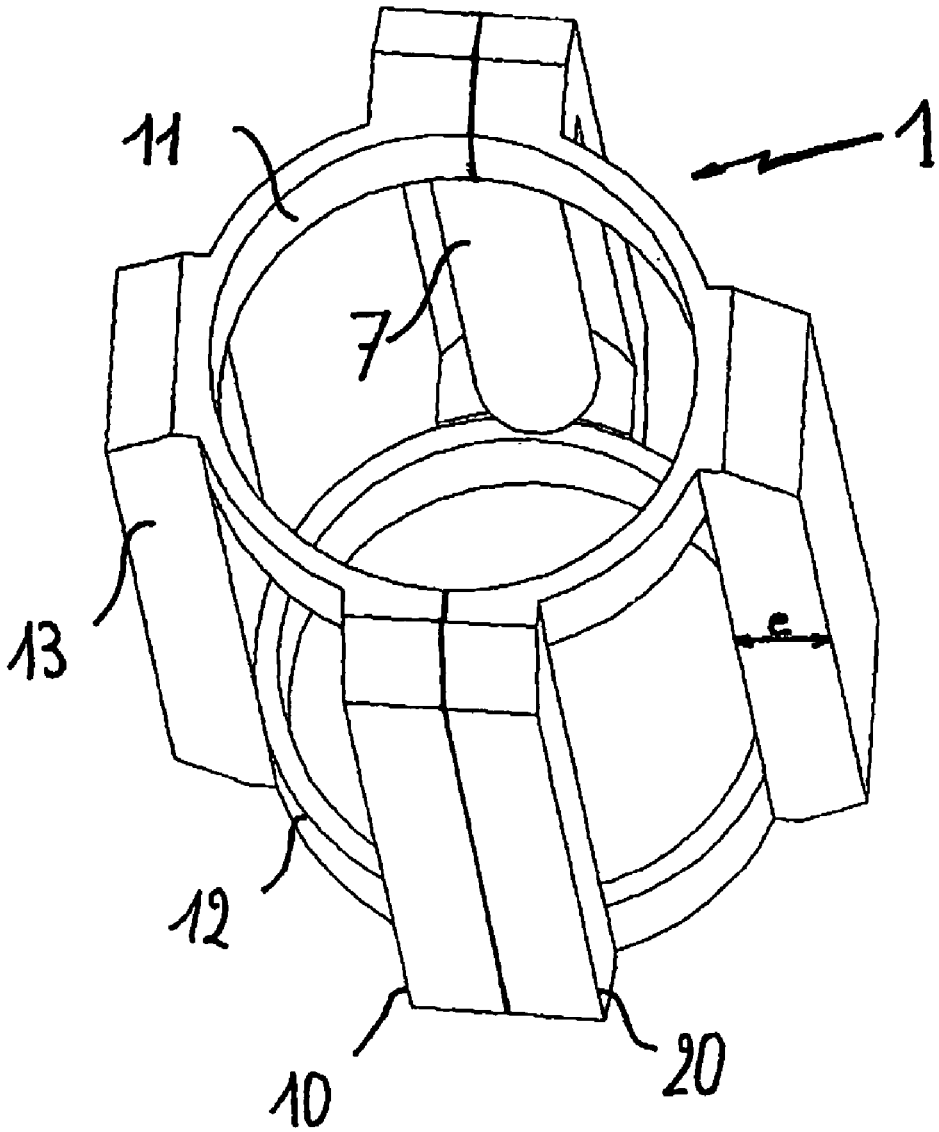
FIG. 1 represents a first example of a centralizer according to an embodiment of the invention.

As shown in FIG. 1, a centralizer 1 according to the invention comprises two identical parts 10 and 20 having the general shape of half-cylinders. These two parts are intended to be rigidly connected to surround a casing (or a tubing) and to direct it at the time of its descent into a conduit (respectively a well passing through a geological formation or a casing). Part 10 (like part 20) comprises two half-rings upper 11 and lower 12 connected by at least a rigid blade 13. This rigid blade 13 has a thickness E higher than that of the upper and lower half-rings, and is directed according to the axis of the conduit. In this manner, when one assembles parts 10 and 20 for example on a casing and lowers this casing into a well passing through a geological formation, the rigid blades 13 ensure the positioning of casing, generally in a concentric way, compared to the well. Thereafter, when casing is cemented in the well, this concentric positioning will make it possible to obtain a homogeneous thickness of cemented annulus, and therefore a good sealing between the various layers and an optimal production of the well.

The interior wall of centralizer 1, for example the interior wall of one of the rigid blades 13 has a recess intended to accomodate a sensor 7. This sensor can be a flow, pressure, temperature gauge or any other sensor according to the parameters, the evolution of which one wishes to know in a permanent manner. The sensor is connected to means of feeding and recovery of data (not represented). The means of feeding can comprise, in a known manner, a power source, located on the surface to facilitate its maintenance, connected to the centralizer according to the invention by electric cables running along the casing. In another example, the current is brought to the sensor by induction while circulating current directly in the casing which in this case will be metal.

In this manner, one can equip a casing at least with as many sensors than there are centralizers, without overloading the unit. Moreover, this example is particularly advantageous for the most fragile sensors which are quickly likely to deteriorate in a well (even during running in the casing). Indeed, these sensors are protected by the structure of the centralizer which is itself, particularly solid since it must resist friction against the walls of the well at the time of the descent.

Figure 2:
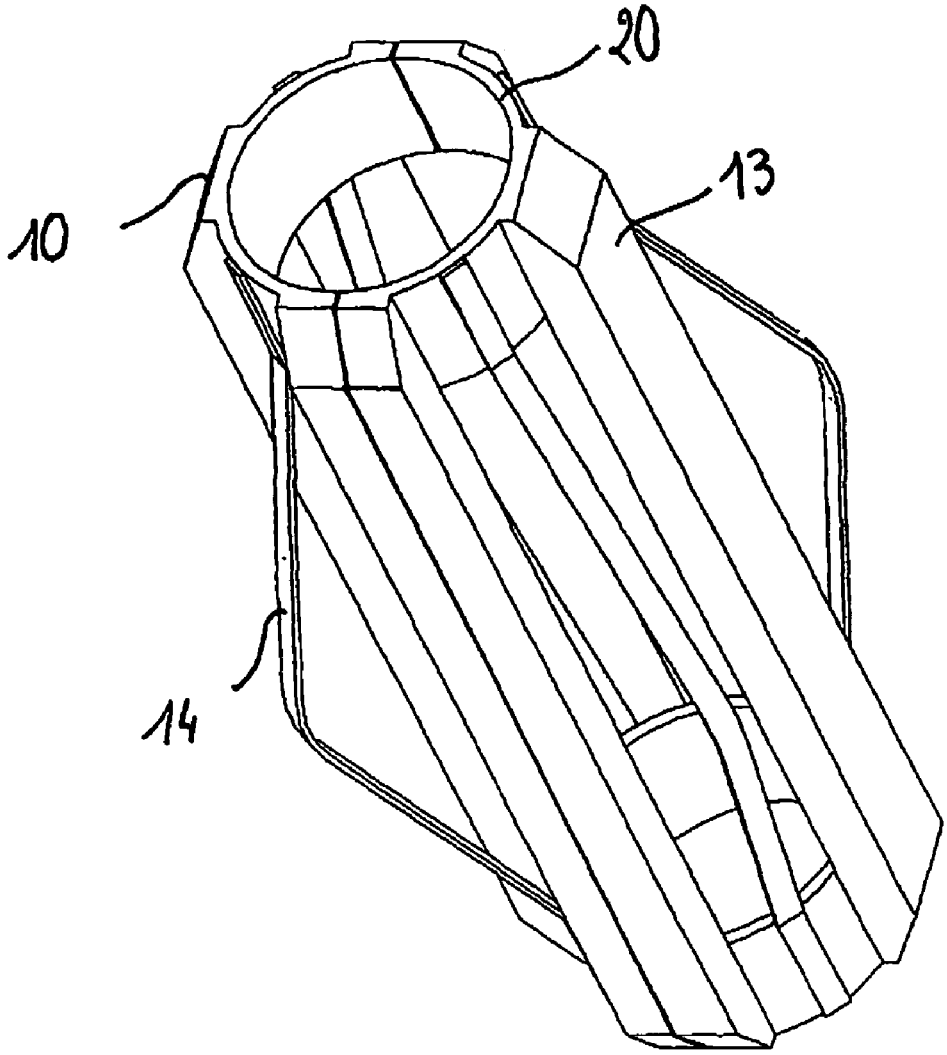
FIG. 2 represents a second example of a centralizer according to an embodiment of the invention.

FIG. 2 represents another example of a centralizer 1 according to the invention. In this device, the rigid blades 13 were replaced by flexible blades 14. Each flexible blade is substantially convex and elastic. It is prominent compared to the whole of the centralizer, i.e. when this device is lowered in a conduit such as a well, the flexible blades 14 rub against the walls of the well. When the conduit is a casing, the flexible blades, fixed on tubing, rub against the walls of casing. In this manner, in fact the flexible blades make it possible to position the casing compared to the conduit These flexible blades, when they are fed with electrical current and are connected to means of recording of the data, also constitute very effective electrodes for injection, return and measurement for taking measurements of resistivity, for example in underground formations surrounding the conduit. Indeed, the shape of these blades is such as it makes it possible to rigorously follow the walls of the conduit by always ensuring a contact pressure with these walls. Thus, one very substantially decreases the risks of loss of current in the casing, which improves the precision of measurements. To carry out measurements of resistivity when the annulus between the casing and the conduit is cemented, the centralizer of FIG. 2, playing the role of injection electrode, is fed with current by cables or induction. Other centralizers in conformity with the invention can constitute measurement and reference electrodes, on the same principle as that described in the patent FR 93-13720

Figure 3:
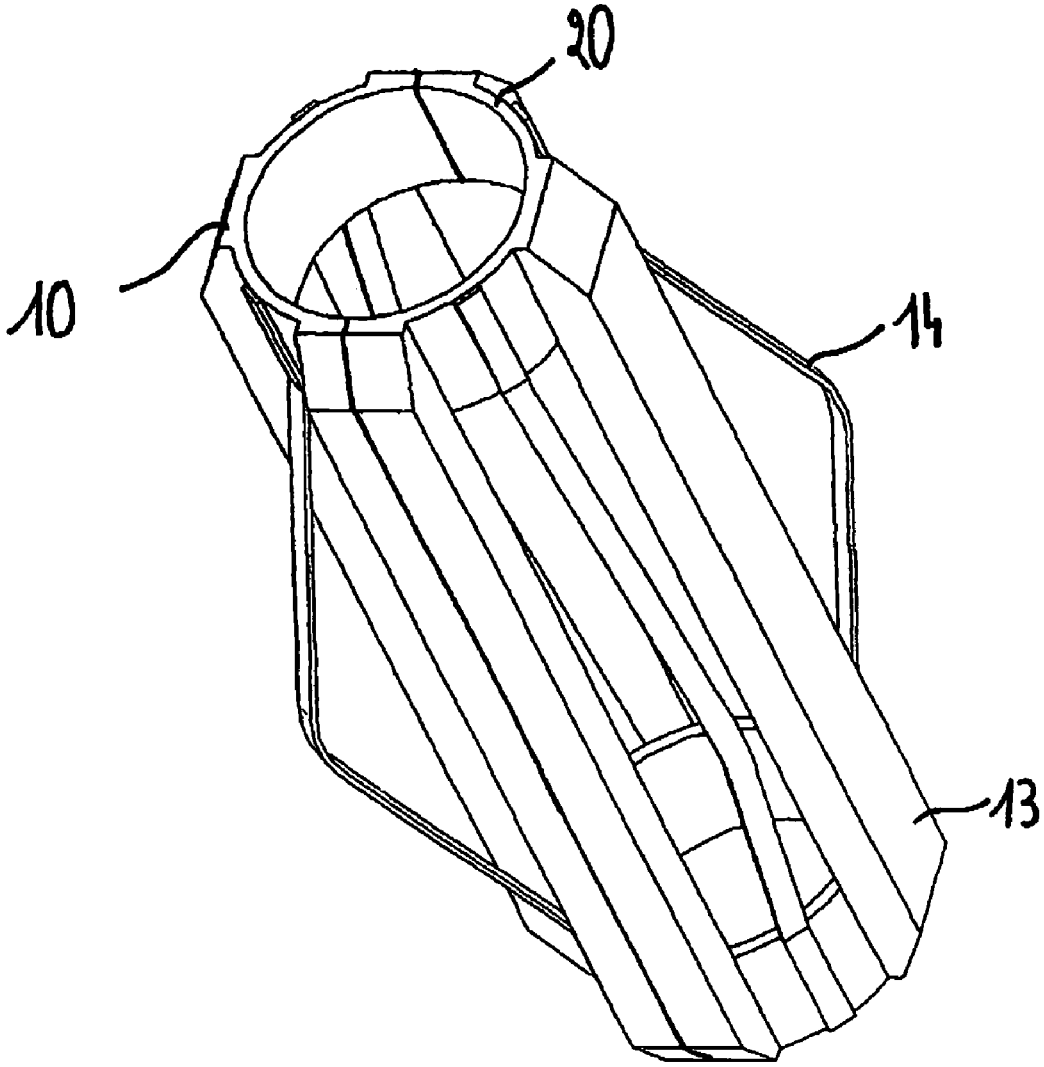
FIG. 3 represents a third example of a centralize according to an embodiment of the invention.

FIG. 3 represents a particularly advantageous example of a centralizer in conformity with the invention which comprises the two examples previously described. Indeed in this device, each part 10, 20 comprises in addition to one rigid blade 13 at least one flexible blade 14. This has a first advantage of combining the effects of positioning of the two types of blades. Thus, the rigid blades also take part in good positioning, by guaranteeing a minimum annular space if the flexible blades, which are initially in contact with the walls of the conduit, would be too flexible to position the casing effectively. Moreover, this centralizer also makes it possible to perform at the same time the role of current injection electrode or measurement electrode with the flexible blades 14 but also carries in a recess of the interior wall of a rigid blade 13 one or more sensors such as flow, temperature, pressure pick-ups.

Figure 4:
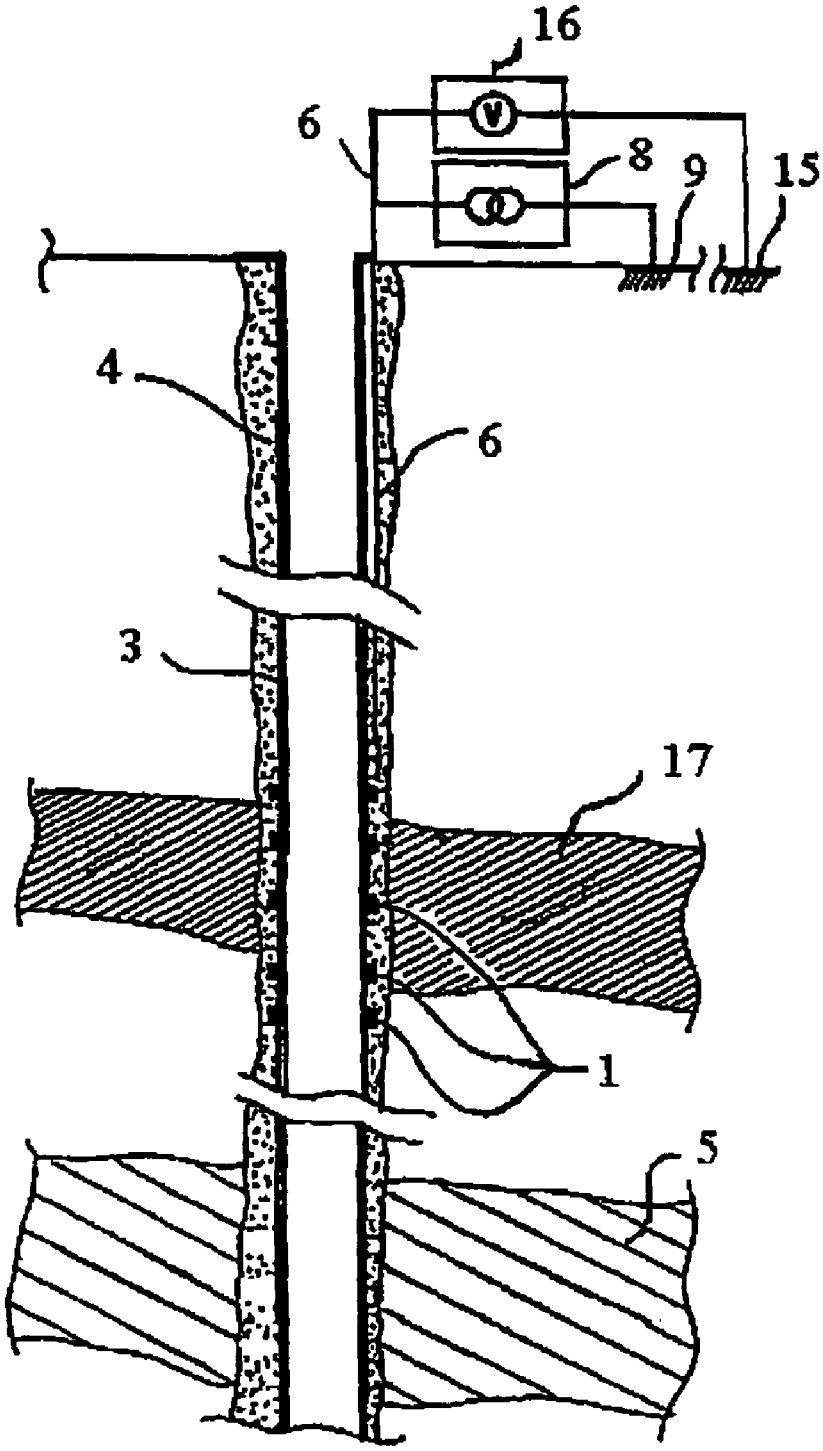
FIG. 4 represents an example of the use of a centralizer according to an embodiment of the invention.

FIG. 4 represents an example of application of centralizers according to the invention. A casing 3 was lowered and cemented into a well 4 through an underground formation including a reservoir 5 for example of hydrocarbons. Casing 3 is positioned concentrically with the well thanks to a plurality of centralizers in conformity with the invention, regularly distributed over all its length. An injection electrode 9 is connected to means of feeding electrical current 8 and laid out in this example on the surface. This injection electrode makes it possible to run a current through the formation. Casing 3 electrically carries on its external surface an insulator material coating. Electronic means of data processing 16 are also located at the surface and connected to the centralizers 1 via cables 6 so that the aforementioned centralizers also constitute measurement electrodes in order to raise the potential differences compared to a reference electrode 15, located on the surface and known in the state of the art Thus, starting from the potential differences, one can determine from the resistivity of the formation surrounding the well 4, for example the position of a water front 17. Cables 6 also make it possible to feed electrical current to temperature (or pressure) sensors 7, (not shown on the figure), located in a recess of the rigid blades 13 of the centralizers 1

The centralizer according to the invention thus makes it possible simply to couple a function of positioning of a casing in a conduit with measurements of parameters representative of the formation and/or effluent resulting from a reservoir present in this formation. This device can also be used for conduits located on the surface.

The invention claimed is:

1. A centralizer for positioning a casing in a conduit passing trough underground formations, the centralizer comprising:

at least two substantially semi-cylindrical parts that can be fixed to one another so as to surround the casing;

a plurality of blades; and measurement means for determining at least one parameter representative of the formations; wherein at least one blade in the plurality of blades is rigid and an internal wall of the rigid blade comprises a recess which receives the measurement means.

2. The centralizer as claimed in claim 1, wherein each substantially semi-cylindrical part comprises two half-rings separated by blades extending parallel to the axis from the conduit, the blades acting in use to maintain a certain annular distance between the casing and the conduit.

3. The centralizer as claimed in claim 2, wherein at least one of the blades is flexible and has an substantially convex form so that in use the blade is in contact with the walls of the conduit.

4. The centralizer as claimed in claim 3, further comprising electrical current feeding means which, in use, injects a current in the flexible blade.

5. The centralizer as claimed in claim 1, wherein the at least one parameter representative of the formations comprises the resistivity of the formations surrounding the conduit.

6. A method of measurement of at least one parameter representative of an underground formation comprising:

lowering into a conduit passing through the formation a casing provided with at least one centralizer as claimed in claim 1 connecting the measurement mains of the centralizer to an electrical current supply and to a data recording system;

passing an electrical current in the formation; and measuring an electric parameter using the measurement means of the centralizer so as to derive the parameter representative of the formation therefrom.

* * * * *